United States Patent [19]

Heitzman

[11] 4,101,075

[45] * Jul. 18, 1978

[54] PULSATING FLUID SPRAY DEVICE

[76] Inventor: Charles J. Heitzman, 1024 Waieli St., Honolulu, Hi. 96821

[ * ] Notice: The portion of the term of this patent subsequent to Mar. 8, 1994, has been disclaimed.

[21] Appl. No.: 796,190

[22] Filed: May 12, 1977

[51] Int. Cl.[2] ..... B05B 1/08

[52] U.S. Cl. ..... 239/101; 239/383; 239/447; 239/563

[58] Field of Search ..... 239/101, 102, 383, 447, 239/562, 563, 558

[56] References Cited

U.S. PATENT DOCUMENTS

| | | | |
|---|---|---|---|
| 3,473,736 | 10/1969 | Heitzman | 239/101 |
| 3,568,716 | 3/1971 | Heitzman | 239/383 X |
| 3,713,587 | 1/1973 | Carson | 239/383 |
| 3,762,648 | 10/1973 | Deines et al. | 239/383 |

*Primary Examiner*—Robert W. Saifer

*Attorney, Agent, or Firm*—Jacox & Meckstroth

[57] ABSTRACT

A shower head includes a tubular body or housing defining a fluid passage which is connected by a plurality of angularly disposed parts directly to a corresponding plurality of fluid chambers. The chambers are defined by axially extending partitions formed as an integral part of the discharge end portion of the housing and are enclosed by a perforated cover member removably secured to the housing. A fluid driven turbine-type valve rotor is supported within the fluid passage by a center pin shaft and includes a projecting closure portion which has a rotating path adjacent the ports for successively closing the ports and momentarily restricting the flow of fluid from the fluid passage into the corresponding fluid chambers. When it is desired to discharge a steady spray, either the cover member is partially released from the housing to provide for fluid communication among the chambers or rotation of the valve rotor is stopped at a predetermined position.

7 Claims, 5 Drawing Figures

PULSATING FLUID SPRAY DEVICE

BACKGROUND OF THE INVENTION

In the art of pulsating fluid or water spray devices such as disclosed in U.S. Pat. Nos. 2,878,066 and 3,762,648, it has been found desirable to pulsate the water discharge spray by means of a simplified rotary turbine valve system of the type disclosed in applicant's U.S. Pat. No. 3,473,736 and No. 3,568,716. This simplified construction of the spray device not only provides for an economical assembly but also assures dependable operation which is especially desirable when the device is used as a pulsating shower head. In addition, it is desirable for a pulsating shower head to minimize the problem of "water hammer" which is commonly associated with a residential water supply system when the flow of water through a supply line is abruptly stopped.

SUMMARY OF THE INVENTION

The present invention is directed to an improved pulsating fluid spray device which is adapted to be used as a shower head and which provides all of the desirable features and advantages mentioned above. That is, the pulsating fluid spray device of the invention provides for a simplified and economical construction and assures that the pulsating discharge water spray does not result in producing an objectionable "water hammer" noise within the fluid or water supply line connected to the device. The invention also incorporates a simplified means for shifting between a pulsating spray discharge and a continuous spray discharge.

In general, the above features are provided in the illustrated embodiment by means of a tubular housing which defines a primary fluid passage and has a discharge end portion divided into compartments or chambers by a plurality of axially extending and angularly disposed walls or partitions formed as an integral part of the housing. The partitions define corresponding fluid chambers therebetween, and each fluid chamber is connected directly to the primary fluid passage by a corresponding port formed within a valve stator wall.

A disc-like fluid directing member or element is positioned within the housing and directs fluid streams against the valve rotor which is rotatably supported by a support pin projecting upstream from the valve stator wall. The valve rotor includes a projecting portion having a rotational path adjacent the ports within the valve stator wall and which successively closes the ports and momentarily restricts the flow of fluid into the corresponding fluid chambers to effect momentary interruption in the spray discharge from the corresponding orifices associated with the chamber. The discharge orifices are defined within an end cap which is threadably connected to the housing and which may be partially released when it is desired to have a continous spray discharge from the orifices.

Other features and advantages of the invention will be apparent from the following description, the accompanying drawing and the appended claims.

DESCRIPTION OF THE PREFERRED EMBODIMENT

Figure 1:
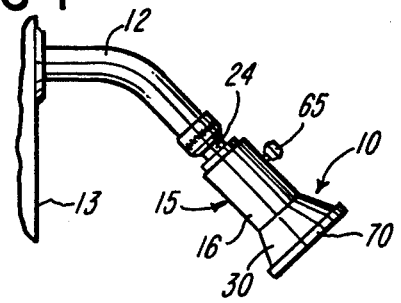
FIG. 1 is an elevational view of a pulsating fluid spray device constructed in accordance with the invention and illustrated in the form of a shower head.

In reference to the drawing, FIG. 1 illustrates a pulsating fluid srapy device in the form of a shower head assembly 10 which is adapted to be connected to a water supply line 12 projecting from a shower wall surface 13. The shower head assembly 10 incorporates a body or housing 15 which includes an elongated tubular portion 16 having an internally threaded upper end portion 17. The tubular portion 16 may be molded of a plastics material or as a metal die casting and defines an internal fluid passage 18. A tubular fitting 19 is threaded into the upper end portion 17 and has an inwardly projecting annular flange 21 which defines a circular water inlet 22 for the fluid passage 18. The fitting 19 confines an annular sealing washer 23 which engages the spherical end portion of a swivel-type tubular coupling 24. The coupling 24 has an internally threaded upper end portion 26 which is adapted to be secured to the threaded outer end portion of the water supply tube or line 12. The part-spherical end portion of the coupling 24 is held against the resilient washer 23 by a tubular bushing 28 which is threaded into the fitting 19.

The housing 15 also includes a generally frusto-conical discharge end portion 30 which is threadably connected at 31 to the lower end of the tubular portion 16 of the housing 15. The discharge end portion 30 may also be molded of a plastics material or formed as a metal die casting and may be formed integrally with the tubular housing portion 16. The discharge end portion 30 includes a series of three uniformly spaced and axially extending walls or partitions 34 which are formed as an integral part of the discharge portion 30 and converge radially inwardly to define therebetween a corresponding series of angularly arranged fluid chambers 35. The upper end portions of the partitions 34 project upwardly into an inverted cup-shaped valve stator or wall portion 38 which cooperates with the partitions 34 to form corresponding upstream extensions of the fluid chambers 35. A series of angularly arranged openings or ports 42 are formed within the stator wall portion 38 and are uniformly spaced to form direct fluid communication between the main fluid passage 18 and the corresponding fluid chambers 35.

Figure 3:
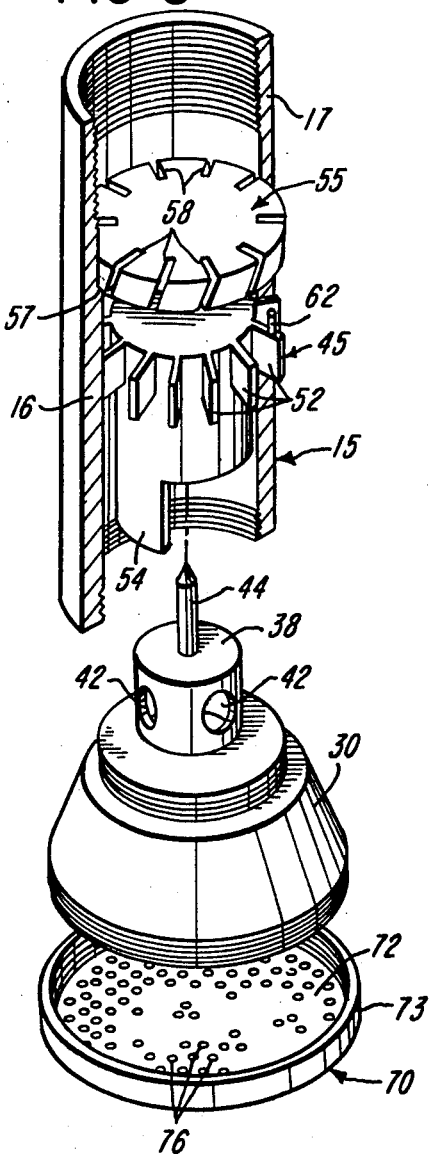
FIG. 3 is an exploded fragmentary perspective view of some of the shower head components shown in FIG. 2.
Figure 4:
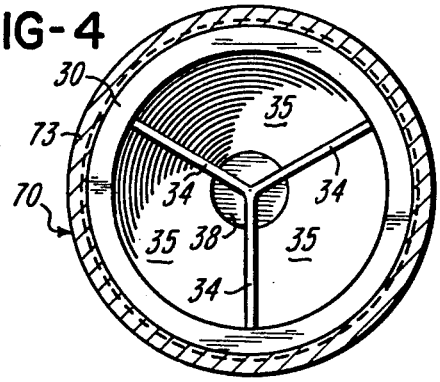
FIG. 4 is a sectional end view taken generally on the line 4—4 of FIG. 2.

A pin-like shaft 44 is formed as an integral part of the discharge end portion 30 of the housing 15 and projects upwardly from the stator wall portion 38 and on the axis of the housing 15 to support a turbine valve rotor 45. The upper end portion of the shaft 44 is generally pointed and engages the inner end surface of a blind cylindrical bore 47 formed within the center of the valve rotor 45. Preferably, the valve rotor 45 is molded of a plastics material and includes a plurality of circumferentially spaced and outwardly projecting turbine vanes 52 which extend in an axial direction as illustrated in FIG. 3. The valve rotor 45 also includes an integral closure portion 54 which projects downwardly adjacent the outer surface of the stator wall portion 38 so that the path of the closure portion 54 immediately surrounds the ports 42. The closure portion 54 extends angularly or circumferentially approximately 120° so that when the closure portion 54 is in a position closing or blocking the fluid flow through one of the ports 42, the other two ports 42 remain open to provide for a direct flow of fluid from the fluid passage 18 into the corresponding fluid chambers 35.

A generally cylindrical fluid guide or directing element 55 is positioned within the passage 18 above the valve rotor 45 and seats on an annular shoulder 57 formed within the housing 15. The fluid directing element 55 has a plurality of peripherally spaced slots 58 each of which is positioned within a corresponding plane extending at an acute angle with respect to the center common axis of the valve rotor 45 and the housing 15.

Figure 2:
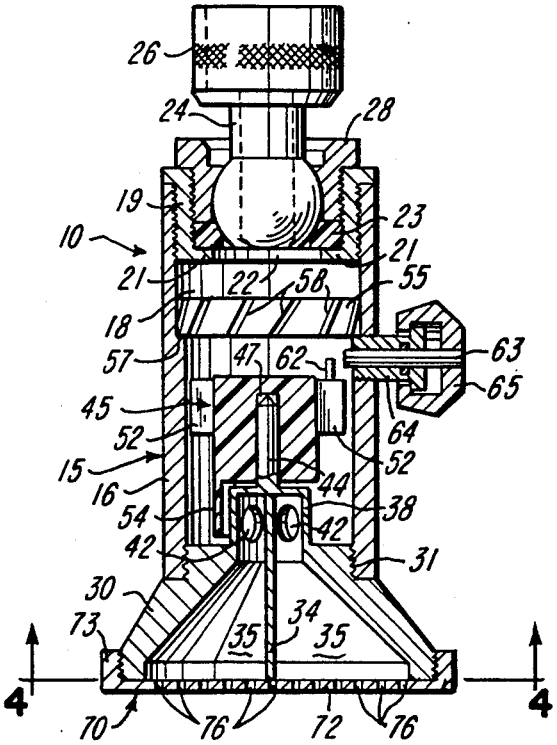
FIG. 2 is an axial section of the shower head shown in FIG. 1.

As shown in FIG. 2, a short projection or stop pin 62 is formed as an integral part of the valve rotor 45 and projects upwardly from one of the vanes 52. A rod 63 is supported for radial sliding movement within a bushing 64 secured to the housing 15 and is connected to a cup-shaped stop button 65 which surrounds the outer flanged end portion of the bushing 64. When the rod 63 and the stop button 65 are depressed inwardly, the rod 63 projects into the rotary path of the pin 62 and stops the rotation of the valve rotor 45 in a position where the closure portion 54 is located between two of the ports 42 so that all of the ports 42 are open to permit direct fluid communication between the fluid passage 18 and the three fluid chambers 35.

The circular end closure member or cap 70 includes a flat wall portion 72 and a peripherally extending flange portion 73. The flange portion 73 has internal threads for engaging corresponding external threads on the lower end of the discharge end portion 30 of the housing 15. A plurality of nozzle discharge orifices 76 are formed within the end closure cap 70 so that the water supplied to each of the chambers 35 is discharged through the orifices 76 in corresponding streams forming a spray. Preferably, each of the orifices 76 is formed by a frusto-conical surface (not shown) which extends from the inner surface of the cap 70 to a cylindrical surface which extends to the outer surface of the cap 70.

In operation of the fluid spray device or shower head described above in connection with FIGS. 1–4, a steady flow of fluid or water through the angularly arranged slots 58 produces reactionary rotation of the valve rotor 45 at a substantially constant RPM depending on the water pressure. The rotation of the closure portion 54 of the valve rotor 45 is effective to close momentarily the ports 42 in a successive manner so that the water flowing from the fluid passage 18 into each of the fluid chambers 35 is interrupted for a fraction of a second. This interruption of the water flow into each chamber 35 produces a corresponding interruption or pulsation of the water streams discharged from the orifices 76 associated with the chamber 35.

As mentioned above, if it is desired to have a continuous spray of water from the discharge orifices 76, the rotation of the valve rotor 45 may be stopped by depressing the button 65 and rod 63 to engage the stop pin 62 on the valve rotor. However, in some installations, for example, where the water supply has a high calcium or iron content, it may be desirable to provide for continuous rotation of the valve rotor 45 at all times when water is being supplied to the shower head and thus prevent the valve rotor from sticking or freezing in the stopped position. In this event, the optional continuous discharge or water spray must be obtained simply by partially unscrewing the end closure member or cap 70. This provides for a direct fluid communication between all of the chambers 35 under the partitions 34 and for a substantially constant or uniform hydraulic pressure within the chambers 35 even though the corresponding ports 42 are momentarily closed due to continuous rotation of the valve rotor 45.

Figure 5:
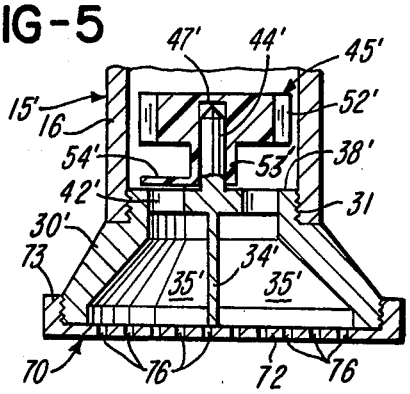
FIG. 5 is a fragmentary axial section of the discharge end portion of a shower head constructed in accordance with a modification of the invention.

In the modification shown in FIG. 5, the tubular housing portion 16 and the closure cap 70 are the same as described above in connection with FIGS. 1–4, and the same reference numbers are used for these components. The components which have been modified are identified with the same corresponding reference numbers, but with the addition of a prime mark after each reference number. Thus in the FIG. 5 modification, the lower housing end portion 30' incorporates a generally flat stator wall 38' which extends in a radial plane with respect to the housing 15' and is provided with three axially extending ports 42' angularly arranged with 120° between ports. The partitions 34' are molded as an integral part of the lower housing end portion 30' and are integrally connected along the center axis of the housing 15'. The partitions 34' extend from the integrally connected stator wall 38' to the closure cap 70 and divide the housing end portion 30' into three uniformly arranged fluid chambers 35'.

A shaft 44' is molded as an integral part of the lower housing end portion 30' and projects upstream from the stator wall 38' on the center axis of the housing 15'. A valve rotor 45' is rotatably supported by the shaft 44' in the same manner as the valve rotor 45 is supported by the shaft 44 described above in connection with FIGS. 3 and 4. The valve rotor 45' includes circumferentially spaced and outwardly projecting vanes 52' and also includes a lower closure portion 54'. The closure portion 54' projects radially outwardly from the bottom of a cylindrical hub portion 53' and has a rotational path adjacent the top surface of the stator wall 38'. The closure portion 54' extends circumferentially approximately 140° and is in the shape of a sector of a circle.

When the valve rotor 45' is rotated in response to the swirling water within the housing portion 16, the closure portion 54' of the valve rotor 45' successively interrupts the flow of water through the ports 42' into the corresponding chambers 35' and thereby produces pulsations of the water discharged from each chamber 35' through the orifices 76. This pulsating action is similar to the pulsating action produced by rotation of the closure portion 54 of the valve rotor 45 past the ports 42 within the stator wall 38 of the embodiment shown in FIGS. 2–4.

From the drawing and the above description, it is apparent that a fluid spray device constructed in accordance with the present invention, provides desirable features and advantages. For example, the device is not only simple and economical in construction but is also effective to produce a uniform pulsating spray discharge without creating objectionable hydraulic noise or "water hammer" within the fluid or water supply line. That is, the momentary closing or stopping of the direct flow of water through only one or less than all of the ports 42 and 42' assures that the full water supply within the line 12 is not abruptly stopped with each pulse or the spray discharge.

As another feature, the support of the valve rotor 45 or 45' by the centrally located stator support shaft 44 or 44' projecting into the blind hole 47 or 47' substantially eliminates the flow of water between the shaft and the valve rotor. As a result, there is no significant accumulation of a lime or iron deposit from the water over an extended period of use, thereby assuring continued rotation of the valve rotor. As mentioned above, the end closure member or cap 70 also provides for quickly and conveniently converting the spray device or shower head between a pulsating spray discharge and a continuous spray discharge.

While the forms of spray device herein described constitute preferred embodiments of the invention, it is to be understood that the invention is not limited to these precise forms of device, and that changes may be made therein without departing from the scope and spirit of the invention as defined in the appended claims.

I claim:

1. A pulsating fluid spray device adapted for use as a shower head, comprising a housing defining a fluid passage having an inlet adapted to be connected to a fluid supply, said housing including a discharge end portion having a plurality of angularly disposed partitions defining a corresponding plurality of fluid chambers therebetween, a discharge end wall connected to said housing and having means defining a plurality of nozzle discharge orifices for each of said fluid chambers, a generally flat stator wall connected to said housing and spaced upstream from said discharge end wall in generally parallel relation, said partitions extending from said stator wall to said discharge end wall, means defining a plurality of angularly spaced ports within said stator wall between said partitions and providing for a flow of fluid from said fluid passage directly into said fluid chambers, a turbine valve rotor including a projecting closure portion having a rotational path adjacent said ports for successively closing said ports momentarily restricting the flow of fluid from said fluid passage into said fluid chambers in response to rotation of said valve rotor, and means within said housing for directing the fluid along a path to produce rotation of said valve rotor for pulsating the fluid discharged from said orifices.

2. A fluid spray device as defined in claim 1 wheren said partitions are integrally connected to said stator wall and said discharge end portion of said housing.

3. A fluid spray device as defined in claim 1 wherein said housing includes a tubular portion removably connected to said discharge end portion, and said discharge end portion is radially enlarged adjacent said end wall.

4. A fluid spray device as defined in claim 3 wherein said discharge end portion includes an annular wall integrally connecting said partitions and said stator wall.

5. A fluid spray device as defined in claim 1 wherein said closure portion of said valve rotor comprises a single wall sector projecting radially outwardly and extending angularly greater than 90°.

6. A fluid spray device as defined in claim 1 wherein said partitions extend substantially in corresponding axial planes and are integrally connected along the axis of rotation of said rotor.

7. A fluid spray device as defined in claim 1 wherein only three of said partitions extend inwardly from said discharge end portion towards the axis of rotation of said rotor, and only three of said ports extend axially through said stator wall between said partitions.

* * * * *